US007954202B1

(12) United States Patent
Ragner

(10) Patent No.: US 7,954,202 B1
(45) Date of Patent: Jun. 7, 2011

(54) PIVOTAL NOZZLE ARMS WITH EXTERNAL HOSE PORT

(76) Inventor: Gary Dean Ragner, Gainesville, FL (US)

( * ) Notice: Subject to any disclaimer, the term of this patent is extended or adjusted under 35 U.S.C. 154(b) by 29 days.

(21) Appl. No.: 12/387,516

(22) Filed: May 4, 2009

Related U.S. Application Data

(60) Provisional application No. 61/126,361, filed on May 3, 2008.

(51) Int. Cl.
*A47L 9/02* (2006.01)

(52) U.S. Cl. ..... 15/416

(58) Field of Classification Search ..... 15/393, 15/398, 415.1, 416; *A47L 9/02*
See application file for complete search history.

(56) References Cited

U.S. PATENT DOCUMENTS 5,502,870 A 4/1996 Ragner et al.
5,826,301 A * 10/1998 Kang et al. ..... 15/416

* cited by examiner

*Primary Examiner* — David A Redding

(57) ABSTRACT

A multifunction vacuum nozzle (20) with a nozzle body (30) comprising two tool ends (60A and 60B), where tool end (60B) supports a pair of pivotal arms (40L and 40R) pivotally attached at pivot holes (32L and 32R) and pivotal between an substantially closed position (FIG. 3A) and a substantially open position (FIG. 3B—see position 45). Tool end (60A) is adapted to connect a variety of vacuum tools. Connecting tool ends (60A) and (60B) is a suction passageway (38) therethrough the nozzle body. Body (30) is designed to provide a first attachment port (34) at the first tool end (60A) and pivot arms (40L and 40R) are designed to provide a male second attachment port (46) when in their substantially closed position. A suction conduit (70) can be removable attached to both first attachment port (34) and second attachment port (46), to alternately provide suction air to either tool end.

18 Claims, 7 Drawing Sheets

Front View

Perspective View

SIDE VIEW

SIDE VIEW

Figure 1C:
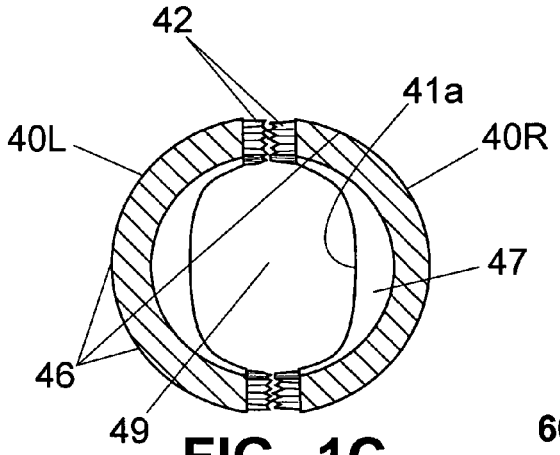

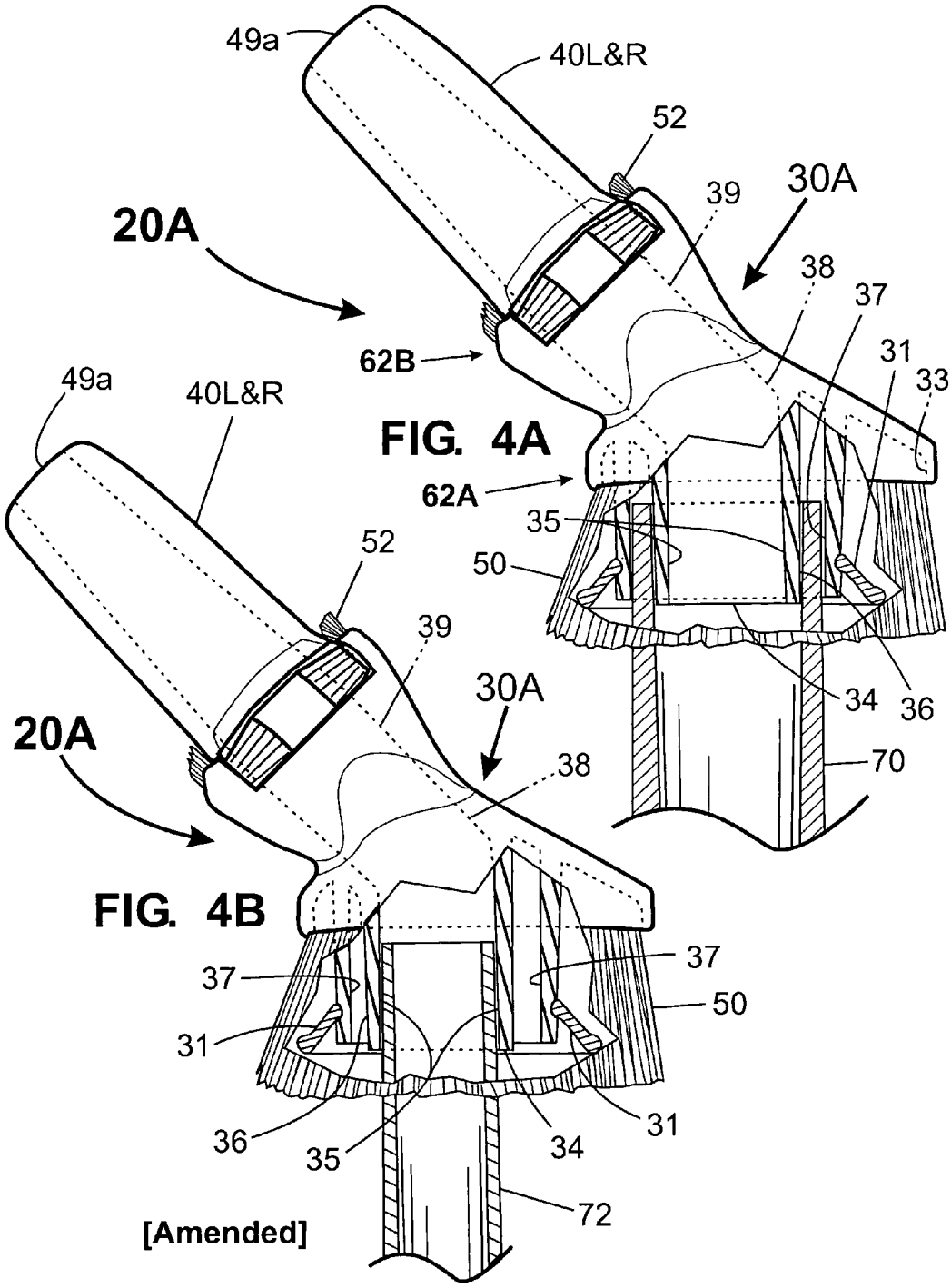
FIG. 4A
FIG. 4B
[Amended]

PIVOTAL NOZZLE ARMS WITH EXTERNAL HOSE PORT

CROSS-REFERENCE TO RELATED APPLICATIONS

This utility application claims priority from U.S. Provisional application Ser. No. 61/126,361, filed on May 3, 2008, titled: "Pivotal Nozzle Arms with External Hose Port".

BACKGROUND OF INVENTION

The field of this invention relates to devices that are used with vacuum cleaner equipment, and more specifically to multifunction vacuum nozzles that include attachment ports at two ends.

Prior art related to invention includes the Applicant's U.S. Pat. No. 5,502,870 to Ragner for a "Five-Function Vacuum Cleaner Nozzle." U.S. Pat. No. 5,502,870 discloses a vacuum nozzle having two functional ends, with one end comprising a pair of pivotal arms. The body of the nozzle provides two suction attachment ports for alternately attaching a suction conduit to provide suction air to one or the other functional ends. U.S. Pat. No. 5,502,870 discloses body of the nozzle with one of the suction attachment ports defined between the pivotal. This makes it awkward to insert a hose wand since the arms must be pivoted out of the way to a particular angle to allow insertion. The presented invention eliminates these problems by using the exterior of the pivotal arms as an attachment port. This allows the user to simply close the arms together to form a male attachment port and then insert it into a female hose wand or suction conduit end, which greatly simplifying the insertion process.

SUMMARY

The disclosed vacuum nozzle has a couple major advantages over previous multifunction nozzles. First the disclosed vacuum nozzle is easier to operate. In past designs, a vacuum hose one was inserted into the nozzle body between the partially opened pivot arms (see U.S. Pat. No. 5,502,870). This required the user to partially open the pivot arms to the correct spread and then insert the hose wand. The problem with prior art nozzles was that both pivot arms must be positioned at the proper angle before the hose wand can be inserted easily. Since the pivot arms can pivot in either direction from this hose insertion angle, the user had difficulty quickly adjusting both arms to the desired angle. Any misalignment of the pivot arms created resistance to the hose wand entry until the proper angle is achieved. This slowed down use of the vacuum nozzle and caused frustration for the user. A second problem was that many people did not intuitively recognize that the hose wand could be inserted between the arms. This was partially due to the difficulty of inserting the hose wand and also because it was not obvious to many users that the hose wand was capable of being inserted between the pivot arms and into the nozzle body. Thus, many users could not perceive the many advantages of the multifunction nozzles of U.S. Pat. No. 5,502,870. The present invention solves these problems by first making it much more intuitive for the user where to connect a hose wand to the disclosed vacuum nozzle and second making the process of angling the arms to the correct angle much easier since the arms only need to be brought together in their closed position to provide a male attachment port for a female hose wand. The arms as they are brought together stops at the desired position for insertion on a hose wand over them.

In past designs, the interior channel between the pivot arms had to be made large enough to accept the hose wand. This increased the size of the base of the pivot arms support on the nozzle and thus made the nozzle itself larger. The present invention solves this problem by eliminating the need to create a hose wand sized passage when the arms are open. Thus, the width and shape of the pivot arms base can now be made smaller if desired, because the hose wand no longer needs to fit between the pivot arms.

OBJECTIVES AND ADVANTAGES

Accordingly, several objects and advantages of my invention are:

a) To provide a multifunction nozzle with two tool ends and two suction attachment ports. Where one attachment port is defined by a male attachment port defined on the body of the nozzle, and the other attachment port is defined on the exterior of a pair of pivotal arms, both ports allowing insertion into a female suction hose wand end (also known as a suction conduit).

b) To provide a multifunction nozzle with two tool ends and two suction attachment ports. Where one attachment port is defined by a male attachment port and a female attachment port defined on the body of the nozzle, and the other attachment port is defining a male attachment port on the exterior of a pair of pivotal arms and a female attachment port on the nozzle body to allow alternate insertion of either male or female suction hose wand end at either one or both of the attachment ports.

c) To provide a multifunction vacuum nozzle with pivotal arms that allows a hose wand to create a seal on the outside of the pivotal arms.

d) To provide a multifunction vacuum nozzle with pivotal arms that are easier to operate by only requiring the pivotal arms to be brought together for the vacuum nozzle to be attached to a suction conduit (suction conduit inserted over the pivotal arms and provide suction air to the nozzle).

e) To provide a multifunction vacuum nozzle with pivotal arms that define a male suction port designed to connect to a female suction conduit (suction hose wand). Where the pivotal arms of the nozzle, when pivoted together, provide a smaller cross-section at their base than prior art multifunction vacuum nozzles with pivotal arms because there is no need for a suction conduit to be inserted into the nozzle body between the arms.

f) To provide a multifunction vacuum nozzle with pivotal arms that does not require a female attachment port on the nozzle body between the pivotal arms, so that the cross-section of the nozzle can be made smaller than prior art multifunction vacuum nozzles having pivotal arms.

g) To provide a multifunction nozzle with two tool ends and two suction attachment ports. Where one tool end and one suction attachment port are defined at substantially opposite ends of the nozzle's body. Where one of the suction attachment ports is defined by a pair of pivotal arms brought together to form a male attachment port defined on the exterior of the pivotal arms, and where the other suction attachment port is defined by a female attachment port defined on the body of the nozzle on the opposite end as the pivotal arms. Where a suction conduit (suction hose wand) is designed to function as a female port for insertion of the pivot arm's male attachment port, and as a male port for insertion in the nozzle body's female suction attachment port.

DRAWING FIGURES

Figure 1B:
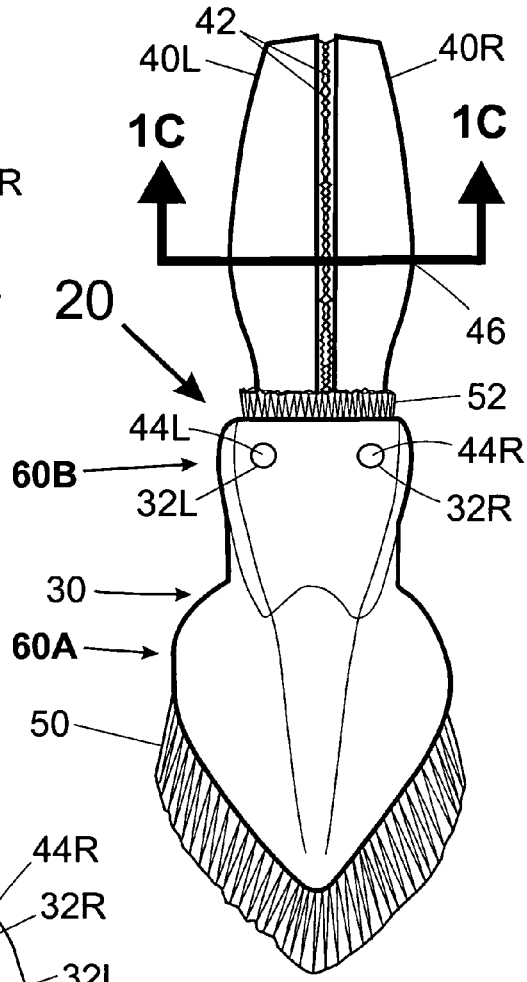
Figure 1A:
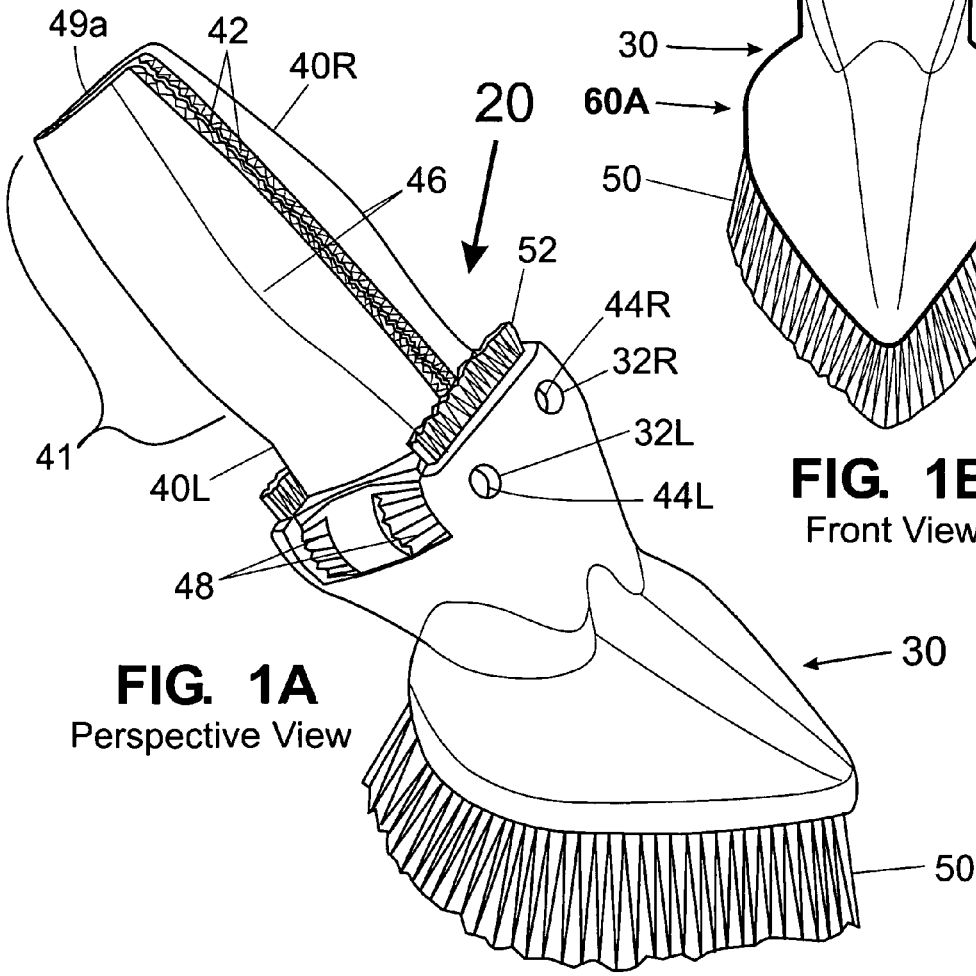

FIG. 1A Perspective view of the first embodiment 20 of the invention.

FIG. 1B Front view of the first embodiment of the invention.

FIG. 1C Section view of the pivotal arms of the preferred embodiment seen in FIG. 1A.

Figures 2A, 2B:
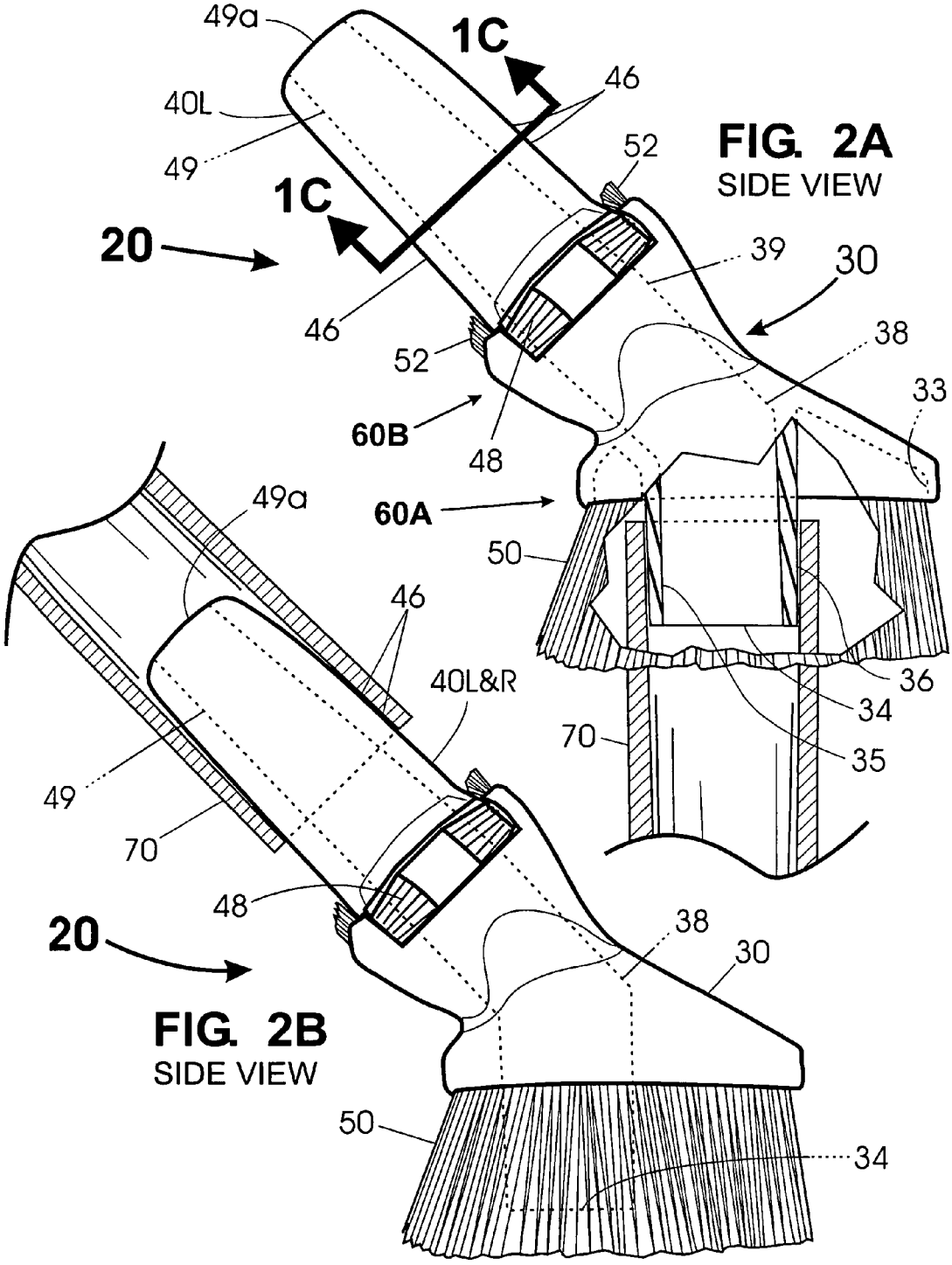

FIG. 2A Left side view of the preferred embodiment of the invention.

FIG. 2B Left side view of the preferred embodiment of the invention, with the end of female hose wand 70 inserted over the male suction ported formed by closed pivotal arms 40L&R.

Figure 3A:
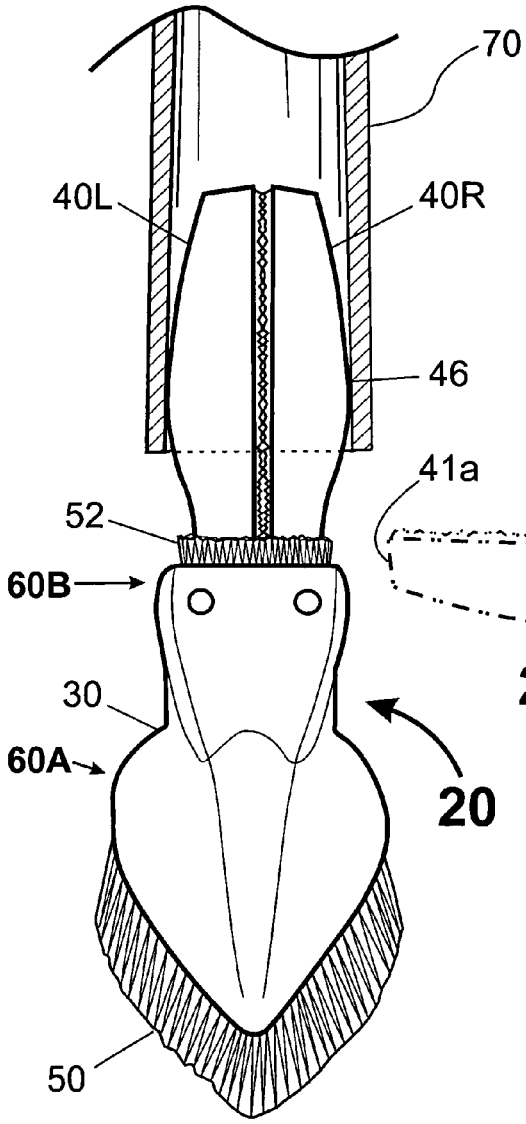

FIG. 3A Front view of the preferred embodiment of the invention, with the end of female hose wand 70 inserted over the male suction ported formed by pivotal arms 40L&R.

Figure 3B:
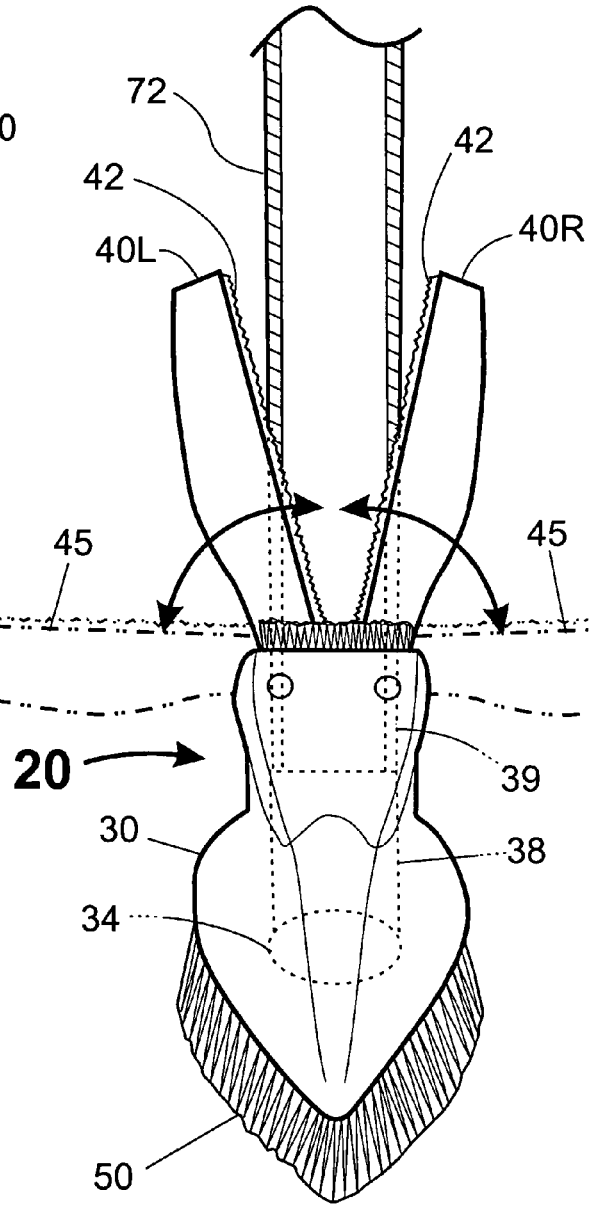

FIG. 3B Front view of the preferred embodiment of the invention, with the end of male hose wand 72 inserted between partially opened pivotal arms 40L&R.

FIG. 4A Left side view of second embodiment 20A of the invention, with the end of female hose wand 70 inserted over the first suction attachment port 34.

FIG. 4B Left side view of the second embodiment of the invention, with the end of male hose wand 72 inserted into first attachment port 34.

Figure 5A:
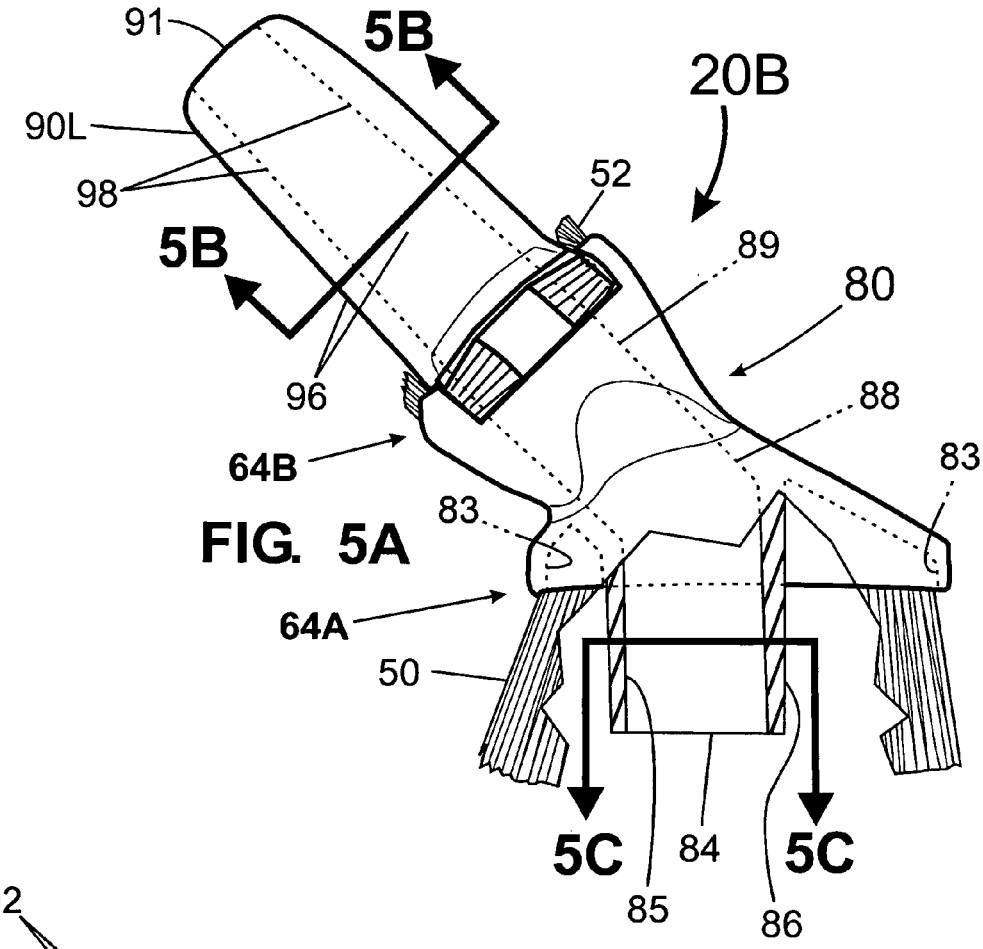

FIG. 5A Left side view of a third alternative embodiment 20B of the invention, partially in section.

Figure 5B:
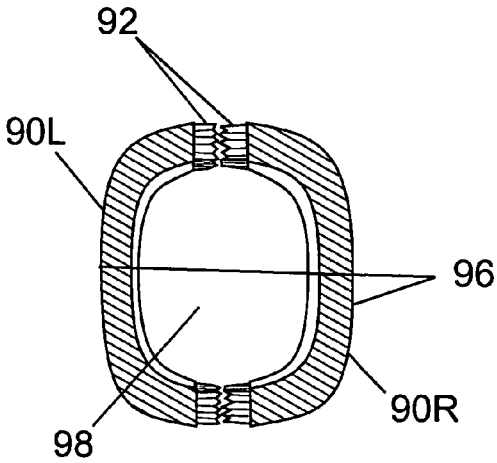

FIG. 5B Section view of the pivot arms of the alternative embodiment seen in FIG. 5A.

Figure 5C:
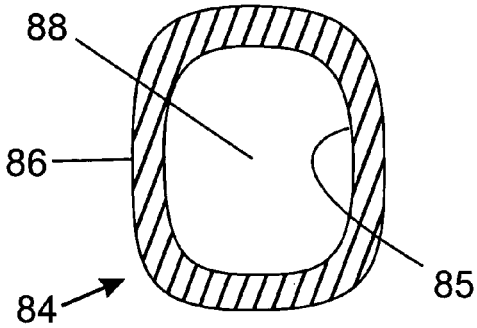

FIG. 5C Section view of the suction port opposite the pivot arms for the alternative embodiment seen in FIG. 5A.

Figure 6:
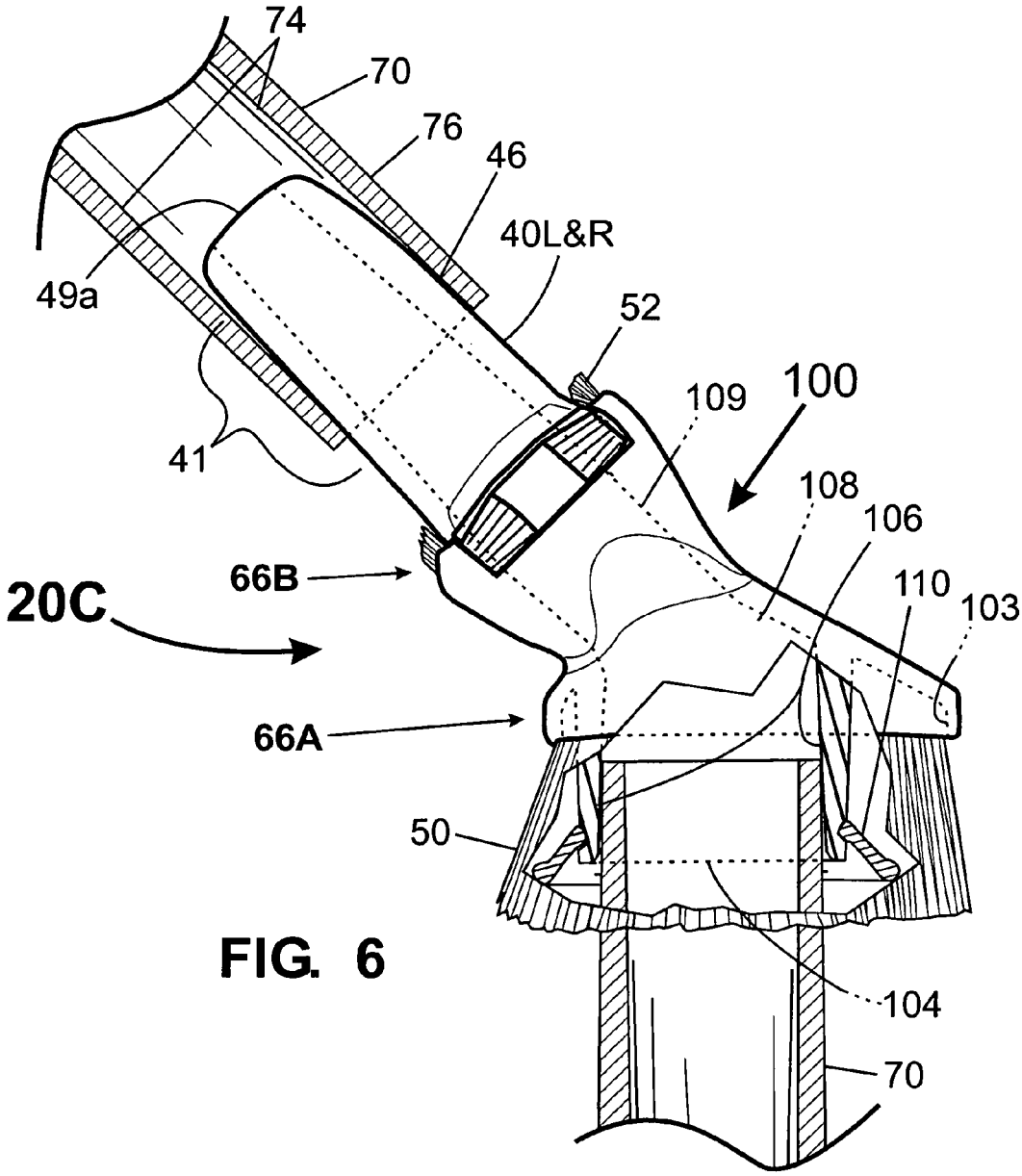

FIG. 6 Left side view of a forth alternative embodiment 20C which is a modified version of the nozzle seen in FIG. 4A.

Figure 7:
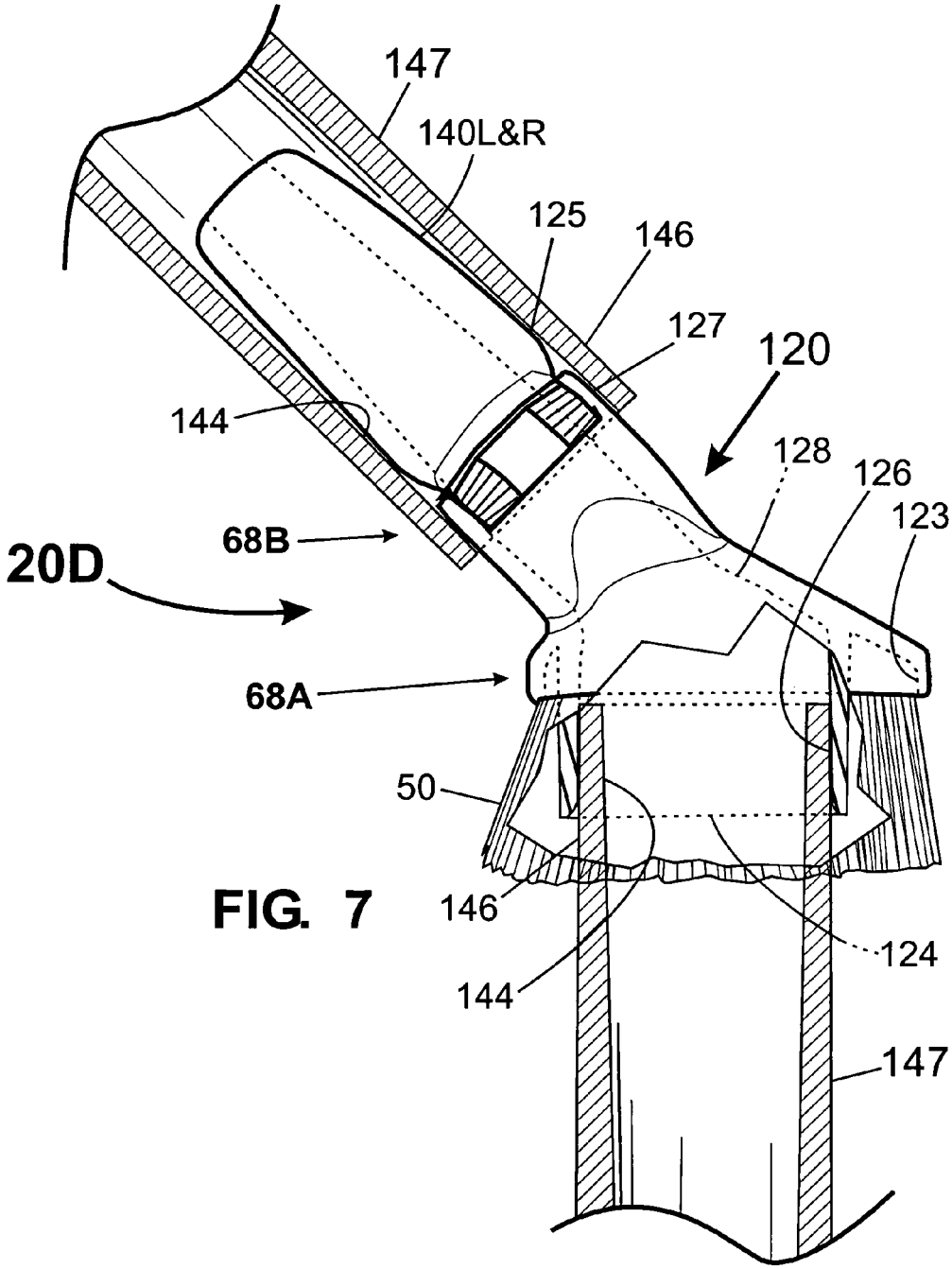

FIG. 7 Left side view of a fifth alternative embodiment 20D, showing attachment of a suction conduit to the exterior of the nozzle body around the pivotal arms.

DETAILED DESCRIPTION OF THE INVENTION

In FIGS. 1A through 3B, we see the preferred embodiment 20 of the disclosed invention, multifunction nozzle 20. Multifunction nozzle 20 comprises a nozzle body 30, a pair of pivotal arms 40L and 40R, a dust brush insert 50 and two brush strips 52. Nozzle body 30 comprises, a first tool end 60A with connector 33 for attaching dust brush 50, a second tool end 60B with pivot holes 44L and 44R for attaching pivotal arms 40R&L, and a suction passageway 38 therethrough nozzle body 30 for communicating suction air in either direction between tool ends 60A and 60B. Nozzle body 30 further comprises, a first attachment port 34 defined on first tool end 60A and adapted to attach to a suction conduit (vacuum hose wand 70, or hose wand 70) and may comprise a third attachment port 39 at the second tool end for attachment to a second suction conduit (vacuum hose wand 72, or hose wand 72) with a smaller cross-section diameter than suction conduit 70. Pivotal arms 40L and 40R comprise a pair of pivot pins 32L and 32R, a set of friction ridges 48, a suction passageway 49 between the first and second tool ends, fiber picker strips 42, and a suction opening 49*a*. When pivot arms 40L and 40R are pivoted together (see FIG. 1A), a second attachment port surface 46 is formed by the exterior of the two pivot arms 40L and 40R and a second suction passageway 49 connecting suction port 49*a* and first suction passageway 38.

Body 30 further comprises a first attachment port 34, a second attachment port 39, and a suction passageway 38 connecting the first and second attachment ports and designed to conduct suction air in either direction. Where the first and second attachment ports are designed for alternate attachment of a hose wand (suction conduit) to each port. The first attachment port 34 comprises a female attachment port surface 35 and a male attachment port surface 36. Female attachment port 35 has substantially the same cross sectional dimensions as female attachment port 39. Male attachment port surface 36 has substantially the same cross sectional dimensions as the outer sealing surface 46 of arms 40L&R when they are pivoted together. This allows hose wand 70 (suction conduit) to alternately attach to either surface 36 or surface 46 to provide suction air to the opposite end of vacuum nozzle 20. The second tool end defines two pairs of pivot holes 32L and 32R for mounting arms 40L&R. The second tool end also defines female attachment port 39 which can be used for attachment of an alternately sized hose wand 72 (see FIG. 3B) to communicate suction air to the first tool end (dust brush 50). Alternate sized hose wand 72 may also be attached to female surface 35 on port 34 to communicate suction air to the second tool end (pivot arms 40L&R). This is accomplished because suction passageway 38 connects attachment ports 39 and 35. Body 30 further comprises a snap groove 33 for removably attaching dust brush 50 to body 30. Snap groove 33 is designed to provide a compression fit for dust brush 50 against body 30, and thereby hold dust brush 50 to body 30 without the use of glue or other adhesives or fastening devices. Body 30 and arms 40L&R can be made of an injection moldable polymer or the like, while brushes 50 and 52 can be made out of natural or synthetic fibers and have a molded plastic or metal strip base as is common in the industry.

In FIG. 1A, we see pivotal arms 40L&R each comprise a sealing surface portion 46, a tool nozzle port 49*a*, two pair of fiber picking strips 42, a pair of pivot tabs 44L and 44R, and a multiplicity of friction ridges 48. When the arms are pivoted together, their interior surfaces define a second suction passageway 49 which connects suction port opening 49*a* to first attachment port 34 and suction passageway 38 (see FIG. 2B). Thus, when hose wand 70 (suction conduit) is attached over closed arms 40L&R, suction air can be communicated from hose wand 70 to port 34 and dust brush 50 (see FIG. 2B). Similarly, when hose wand 70 is attached to attachment port surface 36 of port 34, suction air can be communicated from suction conduit 70 to tool suction port 49*a* in either crevice tool mode (see FIG. 2A) or port 39 in upholstery tool mode (see arm position 45 in FIG. 3B).

In FIGS. 1A and 1B pivotal arms 40L&R when pivoted together defines a male attachment port 41 with a circular sealing surface 46. Thus, arms 40L&R form a second attachment port 41 (arms 40L&R pivoted together) to allow hose wand 70 to connect over port 41 and seal against sealing surface 46, and substantially communicate suction air to suction port 49*a*, through suction passageway 49 to attachment port 39, through suction passageway 38 to first attachment port 34, and then out to dust brush tool 50. Thus, during use, when hose wand 70 (suction conduit) is attached to closed arms 44L&R at sealing surface 46 (second attachment port 41), suction air can be communicated from suction conduit 70 to dust brush 50 for cleaning (see FIG. 2B).

In FIG. 1C, we see the cross section of 40L&R at sealing surface 46. It is this sealing portion 46 of arms 40L&R that seal against the inside of hose wand 70 (see FIG. 2B) to provide suction air to dust brush 50. Surface 46 has a circular cross section to match the circular cross section of hose wand 70. If some other shaped hose wand is used then the cross section at sealing surface 46 should have that general shape also (see FIGS. 5A-C).

In FIGS. 2A and 2B, we see sealing surface 36 and sealing surface 46 are both designed to accept removable attachment of hose wand 70. The cross section of surfaces 36 and 46 are substantially the same so that hose wand 70 fits snugly on each surface and suction air is directed into suction passageway 38 in both cases. Thus, attachment of hose wand 70 to surface 36 provides suction air to the second tool end 60B (arms 40L&R for crevice, upholstery and other cleaning modes of the arms), and attachment of hose wand 70 to surface 46 provides suction air to the first tool end 60A (dust brush 50) for dusting.

In FIG. 3A, pivotal arms 40L and 40R are designed for removable attachment to female hose wand end 70. In FIG. 3B, male hose wand end 72 is designed for removable attachment between opened arms 40L and 40R to seal against attachment port surface 39. In FIG. 3A, hose wand 70 is connected to second tool end 60B (arms 40L&R) by engaging sealing attachment port surface 46. Arms 40L&R must be closed together for hose wand 70 to be attached to surface 46 and provide suction air to dust brush 50 (first tool end). Alternatively, in FIG. 3B, arms 40L&R are partially opened to allow hose wand 72 to attach to surface 39 and provide suction air to the second tool end (arms 40L&R). When either hose wand 70 or 72 are attached to the second tool end, suction air is directed into suction passageway 38 to provide suction air to port 34 and dust brush 50. The pivotal arms can be pivoted anywhere between the substantially closed position shown in FIG. 3A and the fully opened position shown as position 45 in FIG. 3B and independently anywhere in between. Both pivot arm positions shown in FIG. 3B are considered substantially open positions for the pivot arms 40L and 40R, with positions between these two extremes being used for cleaning modes other than crevice tool (FIGS. 1A and 1B) and upholstery tool mode (position 45 in FIG. 3B).

In FIGS. 4A and 4B, we see an alternative vacuum nozzle 20A with alternative nozzle body 30A. The only difference between nozzle 20A and nozzle 20 is that nozzle body 30A has an additional port 37 with a dust brush support gasket 31 attached to it. Additional port 37 is similar to port 34 with a diameter designed to engage the outside of hose wand 70 parallel to port 34. Ports 31 and 37 can be used alone or together. If port 37 is used by itself, the ability to attach smaller hose wand 72 to the dust brush end of the nozzle is removed, and the vacuum nozzle would only allow attachment to a single size hose wand like wand 70. An example of this type of arrangement is shown in FIG. 7.

In FIGS. 4A and 4B, vacuum nozzle 20A comprises arms 40L and 40R, dust brush 50 and modified nozzle body 30A. Nozzle body 30A comprises, attachment ports 34 and 39 similar to those in nozzle body 30, suction passageway 38 similar to the passageway in nozzle body 30, a fourth attachment port surface 37, and a dust brush support gasket 31. For vacuum nozzle 20A, attachment of hose wand 70 to second tool end 62B involves the inside surface of hose wand 70 engages the outside surface of closed arms 40L&R just like shown in FIG. 3A with vacuum nozzle 20. Attachment of hose wand 70 to first tool end 62A involves the outside surface of hose wand 70 engages the interior surface of attachment port surface 37 and/or the inside surface of hose wand 70 engages attachment port surface 36, as shown in FIG. 4A. If attachment port 37 is used by itself (attachment port 34 removed) only hose wand 70 can be attached to the first tool end 62A. If port 34 is used by itself(attachment port 37 removed), both hose wands 70 and 72 can be attached to port 34 either on surface 36 or 35, respectfully. If both port 34 and port 37 are used, hose wand 72 can attach against surface 35 of port 34, and suction conduit (hose wand) 70 can attach between ports 34 and 37 (see FIGS. 4B and 4A, respectfully). Both attachments allow suction conduit 70 to provide suction air to suction passageway 38 and arms 40L&R.

FIGS. 4A through 4B show both hose wands 70 and 72 designed to attach to both the first tool end (port 34) and the second tool end (arms 40L&R). When suction conduits 70 or 72 are attached on the second tool end, suction air is provided to dust brush 50 for cleaning. When suction conduit 70 or 72 is connected to the first tool end 62A at port surface 35, 36 and/or 37, suction air is provided to arms 40L&R which can be used for a number of functions. For example, with arms 40L&R pivoted together as seen in FIGS. 4A and 4B, the arms can be used as a crevice tool. If the arms are spread slightly apart, they can be used to vacuum both sides of vertical and horizontal blinds by slipping the blinds between the fiber strips 42 on the inside of each arm. With one arm in the closed position (arms 40L&R in FIGS. 1A and 1B) and one arm fully open (position 45, FIG. 3B), the right angle formed by the arms can be used to clean angled upholstery edges and stair steps. With both arms open (position 45) the arms form a standard upholstery tool for cleaning upholstery, and other flat surfaces. Additional port 37 is optional if attachment port 34 is present since port 34 can attach to both suction conduits 70 and 72. However, if the outer surface of port 34 (surface 36) is used to attach hose wand 70 it becomes difficult to attach a dust brush support and keep the fibers of dust brush 50 from being sucked into port 34. Nozzle port 37 provides a structure to mount dust brush support gasket 31. Alternatively, gasket 31 or similar support gaskets can be attached directly to dust brush 50 or near where dust brush 50 attaches to body 30 or 30A. If port 37 is used alone (port 34 removed) then it would be able to attach to only one size hose wand (hose wand 70 in this example) but would provide support for a small brush gasket 31.

In FIGS. 5A through 5C, we see a third example embodiment of the multifunction nozzle 20B. In FIG. 5A we see a side view of embodiment 20B, comprising a pair of pivot arms 90L and 90R (see FIG. 5B), a nozzle body 80, a dust brush 50 and a pair of brush inserts 52. Arms 90L&R comprise a "U"-shaped body similar to arms 40L&R as seen in FIGS. 1A through 4B, a pair of fiber picking strips 92 similar to fiber picking strips 42, and a base section that can be identical to the base of arms 40L&R which defines a set of friction ridges 48, and pivot pins 44L&R. However, arms 90L&R are shaped differently and have a more rectangular cross-section than arms 40L&R (see FIG. 5B). This alternate shape for the cross-section of the arms when pivoted together as seen in FIG. 5B can be used to provide alternate functions for specific situations. This alternate example of arms 90L&R is for clarification of how arms 40L&R might be altered for other purposes, and is only one example of the many different ways the arms may be reshaped or changed to provide an external seal when attached to a suction hose wand.

In FIGS. 5A-C, nozzle body 80 comprises, a first tool end 64A with a snap groove 83 designed for attachment of brush 50, a second tool end 64B designed for pivotal attachment of arms 90L and 90R, a pair of brush inserts 52 mounted near the arms, a suction passageway through nozzle body 80, and an attachment port 84 with interior surface 85 and exterior surface 86. Nozzle body 80 is essentially identical to nozzle body 30 except for the shape of first attachment port 84, which has a more rectangular interior port surface 85 and an exterior port surface 86. As seen in FIGS. 5B and 5C, attachment port surfaces 86 and 96 have substantially matching cross-sections (arm surface 96 cross-section is substantially the same size and shape as attachment port surface 86). Exterior port surface 86 is shaped to substantially match the cross-section of arms 90L&R when pivoted together. By making the cross-section of closed arms 90L&R (FIG. 5B) substantially the same as the cross-section of suction port 84 (FIG. 5C) a single custom suction hose wand end (not shown) can be shaped to attach to both ends of nozzle 20B (surface 86 and surface 96). Suction passageway 98 is formed by arms 90L&R when they are pivoted together and communicates with suction port 89 to provide a continuous suction passageway between suction end 91 and suction port 84.

Brush strip 52 attaches to body 80 near arms 90L&R just like they did on body 30, and dust brush 50 attaches to body 80 around port 84 at snap groove 83. Both brushes 52 and 50 can be compression fitted into body 80 to secure them to the body allowing easy replacement, but can also be molded into nozzle body 80 if desired. Arms 90L&R snap into body 80 similar to arms 40L&R onto body 30 at pivot holes 44L&R. This pivotal connection at tool end 64B allows arms 90L&R to pivot between a substantially adjacent position (closed position) to provide an exterior suction port surface 96, a partially open position (see arm position 45 in FIG. 3B) and a substantially open position (see FIG. 3B position 45). In the closed position see FIGS. 5A-B, arms 90L&R allow alternate removable connection of a custom hose wand (not shown) to exterior surface 96 to communicate suction air through suction end 91 and into passageway 98, and ultimately provide suction air to port 84 and dust brush 50. The same hose wand that can be attached to attachment port surface 96 can also be connected to exterior surface 86 of attachment port 84. With the custom hose wand connected to surface 86 suction air is communicated through port 84, passageway 88, and then to port 89 to provide suction air to arms 90L&R, and suction passageway 98 when arms 90L&R are substantially closed (see FIGS. 5A-B). Thus, the custom hose wand (suction conduit) can be removably attached to either tool end of the vacuum nozzle and provide suction air to the opposite tool end. In this way, both tool ends 64A and 64B can alternately be used for suction cleaning.

In FIG. 6, we see a fourth alternative embodiment of the disclosed invention, multifunction nozzle 20C. In FIG. 6 we see a side view of the alternate embodiment 20C, comprising a pair of pivot arms 40L and 40R, a nozzle body 100, a dust brush 50 and a pair of brush inserts 52. Arms 40L&R comprise a "U" shaped body and are the same arms seen in FIGS. 1A through 4B, with a pair of fiber picking strips 42, and a base section that can be identical to the base of arms 40L&R which defines a set of friction ridges 48, and pivot pins 44L&R. Nozzle body 100 comprises, a first tool end 66A comprising a snap groove 103 for holding dust brush 50, an attachment port 104 with interior surface 106, and a support gasket 110 for supporting the bristles of dust brush 50 against suction force, a second tool end 66B comprising pivotal attachment for arms 40L and 40R, and a pair of fiber strips 52, and a suction passageway 108 for communicating suction air in either direction between the two tool ends (tool ends 66A-B). Suction conduit 70 has an interior surface 74 and an exterior surface 76 which are common for vacuum hose wands (suction conduit). Attachment port 41 of pivotal arms 40L&R is designed for exterior surface 46 to engage in removable attachment to the interior surface 74 of hose wand 70 to provide communication of suction air through suction passageways 108 and 109 and provide suction air to dust brush 50. Similarly, interior surface 106 of attachment port 104 is designed to engage in removable attachment to exterior surface 76 of hose wand 70 to provide communication of suction air through suction passageways 109 and 108 and to provide suction air to pivotal arms 40L&R. This arrangement allows nozzle 20D to use both the exterior surface 76 and interior surface 74 of suction conduit 70 for communicating suction air to first attachment port 104 and second attachment port 46, respectfully.

In FIG. 7, we see a fourth alternative embodiment of the disclosed invention, multifunction nozzle 20D. In FIG. 7 we see a side view of the alternate embodiment 20D, comprising a pair of pivot arms 140L and 140R, a nozzle body 120, and a dust brush 50. Arms 140L&R comprise a "U" shaped body similar to pivotal arms 40L&R seen in FIGS. 1A through 4B. Nozzle body 120 comprises, a first tool end 68A comprising a snap groove 123 for holding dust brush 50, an attachment port 124 with interior surface 126, a second tool end 68B comprising pivotal attachment for aims 140L and 140R, and a suction passageway 128 for communicating suction air in either direction between the two tool ends (tool ends 68A-B). Suction conduit 147 has an interior surface 144 and an exterior surface 146 which are common for vacuum hose wands (suction conduit). Second tool end 68B is smaller is cross-section than other tool ends 60B, 62B, 64B, and 66B disclosed in this document, so that, suction conduit 147 does not have to be excessively large and so that suction conduit 147 can be removably attached to attachment port surface 127, of tool end 68B. Attachment port 125 on pivotal arms 140L&R is also designed to engage in removable attachment to suction conduit hose wand 147 on its interior surface 144, to provide communication of suction air through suction passageway 128 and provide suction air to dust brush 50. Both male attachment ports 125 and 127 can be used together or individually as desired in alternative nozzle designs (see FIGS. 2B & 3A for arm attachment port only design). On first tool end 68A, interior surface 126 of attachment port 124 is designed to engage in removable attachment with exterior surface 146 of hose wand 147 to provide communication of suction air through suction passageways 128 and to provide suction air to pivotal arms 40L&R for cleaning. This arrangement allows nozzle 20D to use both exterior attachment surfaces 125 and 126 to provide removable connection of suction conduit 147 to vacuum nozzle 20D. Attach surface 126 can be used alone if desired in an alternate design.

Operational Description—FIGS. 1A T*hrough* 4B

In FIGS. 1A and 1B we see the first example of the disclosed invention. The first tool end (dust brush 50) can be used with arms 40L&R together as shown. Arms 40L&R form a male nozzle port 41 that is designed to attach to hose wand 70 (see FIGS. 2B and 3A). When hose wand 70 (suction conduit) is inserted over arms 40L&R the inside surface of hose wand 70 contacts surface 46 and grips surface 46 by friction contact. When vacuum suction is supplied to hose wand 70, suction air is provided to dust brush 50, through port opening 49*a* in the ends of the arms, through suction passageway 49, through suction passageway 38 and to port 34, which supplies suction air to dust brush 50. With suction air flowing from dust brush 50 to hose wand 70, vacuum nozzle 20 can be used for dusting.

If the second tool end (pivot arms 40L&R) is to be used for cleaning, the user detaches hose wand 70 from arms 40L&R and inserts it over attachment port 34 located within dust brush 50 (see FIG. 2A). Port 34 is forced onto the interior surface of hose wand 70 to provide a friction contact with outer surface 36 of port 34 which holds nozzle 20 securely on hose wand 70. With suction air flowing through hose wand 70, suction air flows through air suction passageways 38 and 49 to provided port 49*a* at the end of closed arms 40L&R with suction air (see FIG. 2A). With the arms closed as seen in FIGS. 1A and 2A, vacuum nozzle 20 can be used as a crevice tool. The user can pivot arms 40L&R around pivot holes 32L&R to a desired angle for cleaning. Friction ridges 48 interact with similar ridges (not seen) on body 30 to hold arms 40L&R at the angle selected by the user. In this way, arms 40L&R can be used to clean differing surfaces, such as stair edges, blinds (both sides at once), upholstery, etc. When arms 40L&R are pivoted to an inline condition as shown by position 45 in FIG. 3B, nozzle 20 can be used as an upholstery tool. To use dust brush 50 again, the user simply pulls hose wand 70 free from attachment port 34, then rotates arms 40L&R back together (FIG. 1A), and then inserts hose wand 70 over the arms to supply suction air to the dust brush again.

FIGS. 3B and 4B, show nozzle 30 and 30A, respectfully being used with a second smaller diameter hose wand 72 (suction conduit). Nozzle body 30A has an additional attachment port 37 with a brush support gasket 31, but is identical to nozzle body 30 in every other way. For this discussion here we will ignore attachment port 37 and brush support gasket 31, and assume body 30A is identical to body 30, to save drawing space. To use dust brush 50 with hose wand 72, arms 40L&R must be spread slightly to allow hose wand 72 access to port 39 as shown in FIG. 3B. When inserted into port 39, suction air from wand 72 provides suction air to passageway 38 and dust brush 50 for cleaning. To use the second tool end (pivot arms), wand 72 is removed from port 39 between the arms and inserted into port 34 as shown in FIG. 4B (ignore the optional attachment port 37 and gasket 31). Suction air from wand 72 is now supplied to suction passageway 38 which supplies suction air to arms 40L&R. The arms can now be used for cleaning upholstery, crevices or other objects. To return to dusting mode, wand 72 is pulled out of port 34 and arms 40L&R are angled as shown in FIG. 3B and wand 72 is inserted back into port 39 to supply suction air to dust brush 50.

As seen in FIGS. 1A through 4B, vacuum nozzle 20 can be alternately attached to a hose wand or suction conduit on either end. Also, both ends of nozzle 20 can accept at least two different suction conduit diameters (hose wand 70 and 72 in this example). While the preferred embodiment allows two different hose wand sizes to be used, the invention works perfectly well without allowing attachment to suction conduit 72 (male hose wand) to either end.

FIGS. 4A and 4B show similar vacuum nozzle 20A, which shows both a first attachment port 34 and an alternate attachment port 37. Ports 34 and 37 do not have to be used together, both ports can provide a functional vacuum nozzle without the other. Port 37 has the advantage of providing a female port for hose wand 70 so that brush support gasket 31 can be mounted on the exterior of port 37. Attachment port 34 cannot do this since hose wand 70 would no longer be able to slide over the exterior of port 34. These are only meant to be examples of possible configurations, and a brush support gasket could be attached nearly anywhere around port 34 as long as it does not interfere with insertion of hose wand 70. In operation, nozzle 20A works substantially the same as nozzle 20 with either port 34 or port 37, or both ports 34 and 37. The only difference is that support gasket 31 helps prevent dust brush 50 from being sucked into port 34 or 37 during use.

Nozzle 20B seen in FIGS. 5A-C, can operate in essentially the same way as nozzles 20 and 20A. The only difference is that attachment ports 96 and 84 have a rectangular cross section instead of a circular cross section. This difference does not substantially affect the hose's operation besides helping prevent rotation of the nozzle around an attached hose wand. However, this is normally not a problem even with round hose wands because the use of friction to attach to a nozzle.

Vacuum nozzle 20C seen in FIG. 6, operate similar to other nozzles presented here. However, in this design both the interior and exterior surfaces of suction conduit 70 are used to attach to nozzle 20C. Interior surface 74 is used to attach to surface 46 of attachment port 41, and exterior surface 76 is used to attach to surface 106 of attachment port 104. Suction conduit 70 can thus be alternately attached to ports 41 and 104 to provide suction air to first tool end 66A (dust brush 50) and second tool end 66B (pivot arms 40L&R), respectfully.

Vacuum nozzle 20D in FIG. 7, operated almost identically to Nozzle 20C in FIG. 6. However, in this design, suction conduit 147 can be inserted much further over pivotal arms 140L and 140R to seal against attachment port 127. Interior surface 144 then engages attachment port surface 127 of nozzle body 120, by friction fit, to provide removable attachment of suction conduit 147 to nozzle 20D. Alternately, suction conduit 147 can be attached to attachment port 124, with exterior surface 146 engaging surface 126 of attachment port 124. Suction conduit 147 can thus be alternately attached to ports 127 and 124 to provide suction air to dust brush 50 and pivot arms 140L and 140R, respectfully. Attachment surface 125 on arms 140L&R provide additional stability if needed between suction conduit 147 and vacuum nozzle 20D.

RAMIFICATIONS, AND SCOPE

The presented vacuum nozzle design provides a substantial improvement over existing multifunction, two-port vacuum nozzles. By allowing connection of a vacuum hose wand (suction conduit) to the exterior of the pivotal arms, the user can more intuitively understand how to connect the hose wand to that side for using the dust brush. Prior art required opening the arms at an angle and then inserting the nozzle between the arms. This ability of the nozzle to accept the hose is difficult to visualize for many people because of the small size of the arms, it does not appear there is enough space for the hose wand. Secondly, it proved difficult coordination wise to pivot the arms to the proper angle for inserting the hose wand. With the present invention, the user can easily close the pivotal arms to provide the proper orientation of the arms for attachment of the hose want to the outer surface of the arms.

Although the above description of the invention contains many specifications, these should not be viewed as limiting the scope of the invention. Instead, the above examples should be considered illustrations of some of the presently preferred embodiments of this invention. For example, there are many possible shapes for the second tool end of the nozzle body so that the hose wand can slip over the closed pivot arms and seal against the second tool end. Also, the example of a dust brush on the first tool end is only one example of many vacuum cleaning tools which could be attached at this end. For example the dust brush could be replaced with a carpet cleaning tool having stiff widely spaced fingers to get deep into a carpet or a floor cleaning tool. Since the dust brush snaps into place in our examples, alternate tools can be attached in its place, such as, a wide floor tool for dusting hard floors, or specialty tools like a ceiling fan cleaner, etc. Further, the first attachment port 34 may be modified to accept a conduit adaptor which may be considered a short suction conduit that has one end designed to attach to the first tool end of the vacuum nozzle, and the other end adapted to attach to a specific sized hose wand or suction conduit. By this means first tool end 60A can be adapted to fit a variety of suction conduits. Such modifications of the nozzle body so that the attachment port is a separate piece, still constitute the same structure after assembled as the disclosed invention.

Thus, the scope of this invention should not be limited to the above examples but should be determined from the following claims:

We claim:

1. A vacuum cleaner nozzle, comprising:

a) a nozzle body having a first tool end and a second tool end, wherein the nozzle body defines a first suction passageway extending through the nozzle body for communicating suction air in either direction between the first and second tool ends;

b) a first attachment port defined on the first tool end of the nozzle body, wherein the first attachment port is in communication with the first suction passageway, wherein the first attachment port is designed for removable attachment to a suction conduit for communicating suction air into the first suction passageway;

c) a pair of pivotal arms mounted adjacent each other on the second tool end and pivotal between a substantially open position and a substantially closed position, wherein the pivotal arms when in their substantially closed position define a second suction passageway in communication with the first suction passageway, and d) wherein the pivotal arms when in the substantially closed position define a second attachment port on the exterior of the pivotal arms, wherein the second attachment port is designed for removable attachment of the suction conduit for communicating suction air into the first and second suction passageways, whereby the suction conduit can be alternately attach to the first attachment port or the second attachment port to provide suction air for the second tool end or first tool end, respectfully.

2. The vacuum cleaner nozzle in claim 1, wherein the first attachment port defines a male port with an exterior surface designed to removably attach to the suction conduit.

3. The vacuum cleaner nozzle in claim 1, wherein the first attachment port defines female port with an interior surface designed to removably attach to the suction conduit.

4. The vacuum cleaner nozzle in claim 3, further including a dust brush mounted on the first tool end.

5. The vacuum cleaner nozzle in claim 3, further including a dust brush mounted on the first tool end, wherein the first attachment port defines a brush support positioned on the interior of the dust brush, wherein the brush support provides mechanical support for the dust brush against vacuum suction pressure during use.

6. The vacuum cleaner nozzle in claim 1, further comprising a dust brush mounted to the first tool end, wherein the first suction passageway is in communication with the dust brush.

7. The vacuum cleaner nozzle in claim 1, wherein the first attachment port defines an interior surface and an exterior surface, wherein the exterior surface is designed for removable attachment of the first suction conduit, and wherein the interior surface is designed for removable attachment to a second suction conduit having a smaller cross section than the first suction conduit.

8. The vacuum cleaner nozzle in claim 1, wherein the nozzle body defines a third attachment port on the second tool end substantially between the two pivotal arms, wherein the third attachment port is designed for removable attachment of a second suction conduit of smaller cross section than the first suction conduit, wherein the pivotal arms opened to allow attachment of the second suction conduit into the third attachment port, wherein the first attachment port defines an interior surface and an exterior surface, wherein the exterior surface is designed for removable attachment to the first suction conduit, and wherein the interior surface is designed for removable attachment to the second suction conduit, whereby two distinct sizes of first and second suction conduits can be attached to the first and second tool ends of the vacuum cleaner nozzle and allowing the vacuum cleaner nozzle to be used with two separate suction conduits.

9. The vacuum cleaner nozzle in claim 1, wherein the suction conduit defines an interior surface and exterior surface, wherein the first attachment port is designed for removable attachment to the exterior of the suction conduit, and the second attachment port is designed for removable attachment to the interior of the suction conduit.

10. A vacuum cleaner nozzle, comprising:

a) a nozzle body comprising a first tool end and a second tool end, wherein the nozzle body defines a first suction passageway extending through the nozzle body for communicating suction air in either direction between the first and second tool ends;

b) a first attachment port defined at the first tool end of the nozzle body and in communication with the first suction passageway, wherein the first attachment port allows removable attachment of a suction conduit, and c) a pair of pivotal arms mounted adjacent each other on the second tool end and pivotal between a substantially open position and a substantially closed position, wherein the pivotal arms when in their substantially closed position define a second suction passageway in communication with the first suction passageway;

d) wherein the pivotal arms when in their substantially closed position allows the suction conduit to slide over the pivotal arms and provide a second attachment port on the exterior of the pivotal arms and/or on the exterior of the second tool end of the nozzle body for conducting suction air through the second suction passageway, wherein the second attachment port provides removable attachment of the suction conduit to the vacuum cleaner nozzle, whereby the suction conduit can be alternately attach to the first attachment port or the second attachment port to provide suction air for the second tool end or first tool end, respectfully.

11. The vacuum cleaner nozzle in claim 10, wherein the first attachment port defines a male port with an exterior surface designed to removable attach to the suction conduit.

12. The vacuum cleaner nozzle in claim 10, wherein the first attachment port defines female port with an interior surface designed to removable attach to the suction conduit.

13. The vacuum cleaner nozzle in claim 12, further including a dust brush mounted on the first tool end, wherein the first attachment port defines a brush support on the interior of the dust brush, wherein the brush support provides mechanical support for the dust brush against vacuum suction pressure.

14. The vacuum cleaner nozzle in claim 10, wherein the suction conduit defines an interior surface and exterior surface, wherein the first attachment port is designed for removable attachment to the exterior of the suction conduit, and the second attachment port is designed for removable attachment to the interior of the suction conduit.

15. The vacuum cleaner nozzle in claim 10, further comprising a dust brush mounted to the first tool end, wherein the first suction passageway is in communication with the dust brush.

16. The vacuum cleaner nozzle in claim 10, wherein the first attachment port defines an interior surface and an exterior surface, wherein the exterior surface is designed to allow removable attachment of the first suction conduit, and wherein the interior surface is designed for removable attachment of a second suction conduit having a smaller cross section than the first suction conduit.

17. The vacuum cleaner nozzle in claim 10 wherein the nozzle body defines a third attachment port on the second tool end substantially between the two pivotal arms, wherein the third attachment port is designed for removable attachment to a second suction conduit of smaller cross section than the first suction conduit, wherein the pivotal arms are substantially opened to allow attachment of the second suction conduit to the third attachment port, wherein the first attachment port defines an interior surface and an exterior surface, wherein the exterior surface is designed to allow removable attachment of the first suction conduit, and wherein the interior surface is designed for removable attachment to the second suction conduit, whereby two distinct sizes of first and second suction conduits can be attached to the first and second tool ends of the vacuum cleaner nozzle and allowing the vacuum cleaner nozzle to be used with two separate suction conduits.

18. The vacuum cleaner nozzle in claim 10, wherein the suction conduit defines an interior surface and exterior surface, wherein the first attachment port is designed for removable attachment to the exterior of the suction conduit, and the second attachment port is designed for removable attachment to the interior of the suction conduit.

* * * * *